US006920372B2

(12) United States Patent
Nickerson et al.

(10) Patent No.: US 6,920,372 B2
(45) Date of Patent: Jul. 19, 2005

(54) AUDIT MONITORING AND PRODUCT DROP SYSTEM FOR RETROFITTING VENDING MACHINES

(76) Inventors: James L. Nickerson, 6705 Glenview, Mayfield Village, OH (US) 44143; Brent Garson, 36850 Pepper Dr., Solon, OH (US) 44139

( * ) Notice: Subject to any disclaimer, the term of this patent is extended or adjusted under 35 U.S.C. 154(b) by 223 days.

(21) Appl. No.: 10/254,732

(22) Filed: Sep. 25, 2002

(65) Prior Publication Data

US 2004/0059465 A1 Mar. 25, 2004

(51) Int. Cl.[7] ..... G06F 17/00

(52) U.S. Cl. ..... 700/244; 700/236; 221/2; 221/9; 221/13

(58) Field of Search ..... 700/231, 236, 700/244, 241; 221/6, 9, 14, 17, 21

(56) References Cited

U.S. PATENT DOCUMENTS

| | | | | | |
|---|---|---|---|---|---|
| 4,108,333 | A | | 8/1978 | Falk et al. | 221/13 |
| 4,252,250 | A | | 2/1981 | Toth | 221/13 |
| 4,869,392 | A | | 9/1989 | Moulding, Jr. et al. | 221/1 |
| 5,111,962 | A | | 5/1992 | Oden | 221/1 |
| 5,442,568 | A | | 8/1995 | Ostendorf et al. | 364/479 |
| 5,756,186 | A | * | 5/1998 | Lievens et al. | 428/195.1 |
| 5,872,646 | A | * | 2/1999 | Alderman et al. | 398/151 |
| 6,202,888 | B1 | * | 3/2001 | Pollock et al. | 221/1 |
| 6,330,958 | B1 | * | 12/2001 | Ruskin et al. | 221/75 |
| 6,354,716 | B1 | * | 3/2002 | Chen et al. | 362/268 |
| 6,384,402 | B1 | | 5/2002 | Hair, III et al. | 250/233 R |
| 6,478,187 | B2 | * | 11/2002 | Simson et al. | 221/75 |
| 6,540,102 | B2 | * | 4/2003 | Gates et al. | 221/75 |
| 6,629,625 | B1 | * | 10/2003 | Paczkowski et al. | 221/2 |
| 2001/0000408 | A1 | | 4/2001 | Hair, III et al. | 250/224 |
| 2002/0117509 | A1 | * | 8/2002 | Whitten et al. | 221/9 |
| 2002/0195458 | A1 | * | 12/2002 | Whitten et al. | 221/244 |

OTHER PUBLICATIONS

2001 Banner Engineering Corp. Article Titled New EZ–Guard.

Automated Merchandising Systems Inc. (AMS) Article Titled the Sensit–I.

Automated Products Company Instruction Manual for Snackshop 7000.

Mars Electronics International Operation and Service Guide Titled Mars Coin Changer Series 4000, VN 4000 and VN 4010XV.

Mars Electronics International Operation and Service Guide Titled Mars Coin Changer Series 2000, VN 2300 and VN 2500.

* cited by examiner

*Primary Examiner*—Khoi H. Tran

(57) ABSTRACT

An audit monitoring and product drop system for retrofitting into an existing vending machine and a method of operating a vending machine is disclosed. A product drop sensor is provided to detect when a product to be dispensed drops through a product drop area of the vending machine. When a product dispensing mechanism is actuated, the output of the product drop sensor is monitored to determine whether a product to be dispensed drops through the product drop area within a predetermined time interval after the product dispensing mechanism is actuated. Transactional information relating to the products dispensed and the funds received are stored in a memory means only if a product drop is sensed by the product drop sensor within the predetermined time period.

20 Claims, 7 Drawing Sheets

AUDIT MONITORING AND PRODUCT DROP SYSTEM FOR RETROFITTING VENDING MACHINES

BACKGROUND OF THE INVENTION

RELATED APPLICATIONS

None

BACKGROUND OF THE INVENTION

The present invention relates to an audit monitoring and product drop system for use in retrofitting existing vending machines and more particularly to an audit monitoring and product drop system which provides for the entry of transaction data into a memory for subsequent retrieval only if a product drop is sensed by the product drop sensor and to a method of operating a vending machine having a product drop system.

Prior art audit monitoring systems are well known in the art and audit monitoring systems for retrofitting existing vending machines are known in the art such as disclosed in U.S. Pat. No. 5,924,081 and U.S. Pat. No. 5,442,562. However, audit monitoring systems for retrofitting existing vending machines do not have the capability to retrofit existing vending machines with a product drop sensor. Product drop systems, for use in OEM manufactured vending machines are disclosed in U.S. Pat. No. 6,384,402 and U.S. Pat. No. 4,252,250 and are also known in the art, but are not readily usable to retrofit existing vending machines. With the vending of products of various configurations, a product drop system including a product drop sensor is becoming more important due to the possibility of miss-vends of a selected product where the selected product dispensing mechanism is actuated, but the selected product is not dispensed.

The present invention overcomes the problems associated with the prior art by providing a new and improved audit monitoring system having a product drop sensor which is capable of retrofitting existing vending machines. The product drop sensor ensures that a product is dispensed before dispensing change and storing transaction data such as products dispensed, total funds received, funds in the cash box and change available to be dispensed.

SUMMARY OF INVENTION

The present invention provides a new and improved audit monitoring and product drop system for retrofit into an existing vending machine having a product selector mechanism, a credit display, a main control board for controlling the vending machine, a plurality of product dispensing mechanisms each of which is operable to dispense a particular product through a product drop area and each of which when actuated dispenses a particular product associated with the actuated product dispensing mechanism through the product drop area and means for receiving funds and dispensing change. The audit monitoring and product drop system includes a control unit having a microprocessor for receiving and transmitting electrical signals to and from the means for receiving funds and dispensing change which are indicative of the funds received, the change to be dispensed, the change available to be dispensed and for enabling and disenabling the means for receiving funds and dispensing change. The microprocessor further receives and transmits signals to and from the main control board of the vending machine which are indicative of the funds received, the change to be dispensed and the status of the vending machine. The microprocessor also receives electrical signals from each of the product dispensing mechanisms indicative of actuation thereof and indicative of which particular product is to be vended. A product drop sensor is operative to send a signal to the microprocessor indicative of a product drop when a product to be dispensed drops through the product drop area. A memory may be provided for storing from the microprocessor transaction information including products dispensed, total amount vended, and funds in the means for receiving funds and dispensing change. The actuation of the product dispensing mechanism to dispense a particular product causes the microprocessor to initiate a predetermined timing period during which the microprocessor senses the output of the product drop sensor to determine if a product to be dispensed passes through the product drop area and effects storage of the transaction information in the memory only if a product dropped is sensed by the product drop sensor within the predetermined timing period.

The present invention further provides a new and improved method of operating a vending machine having a plurality of product dispensing mechanisms, means for receiving funds and dispensing change, a product drop sensor for sensing the passage of a product through a product drop area, and a memory for storing transactional information including funds received in the means for receiving funds and dispensing change and products dispensed. The method includes the steps of entering a credit into the means for receiving funds and dispensing change, operating a selected one of the plurality of product dispensing mechanisms in response to a credit being entered into the means for receiving funds and dispensing change, sensing the operation of a selected product dispensing mechanism, initiating a predetermined timing period during which it is desired to sense the passage of a product through the product drop area in response to sensing the operation of the selected product dispensing mechanism, monitoring the output of the product drop sensor during said predetermined time period to determine if a product passes through the product drop area, and instructing the means for receiving funds and dispensing change to dispense the correct change if the product drop sensor indicates that a product has dropped through the product drop area within the predetermined timing period.

DESCRIPTION OF THE PREFERRED EMBODIMENT

Figure 3:
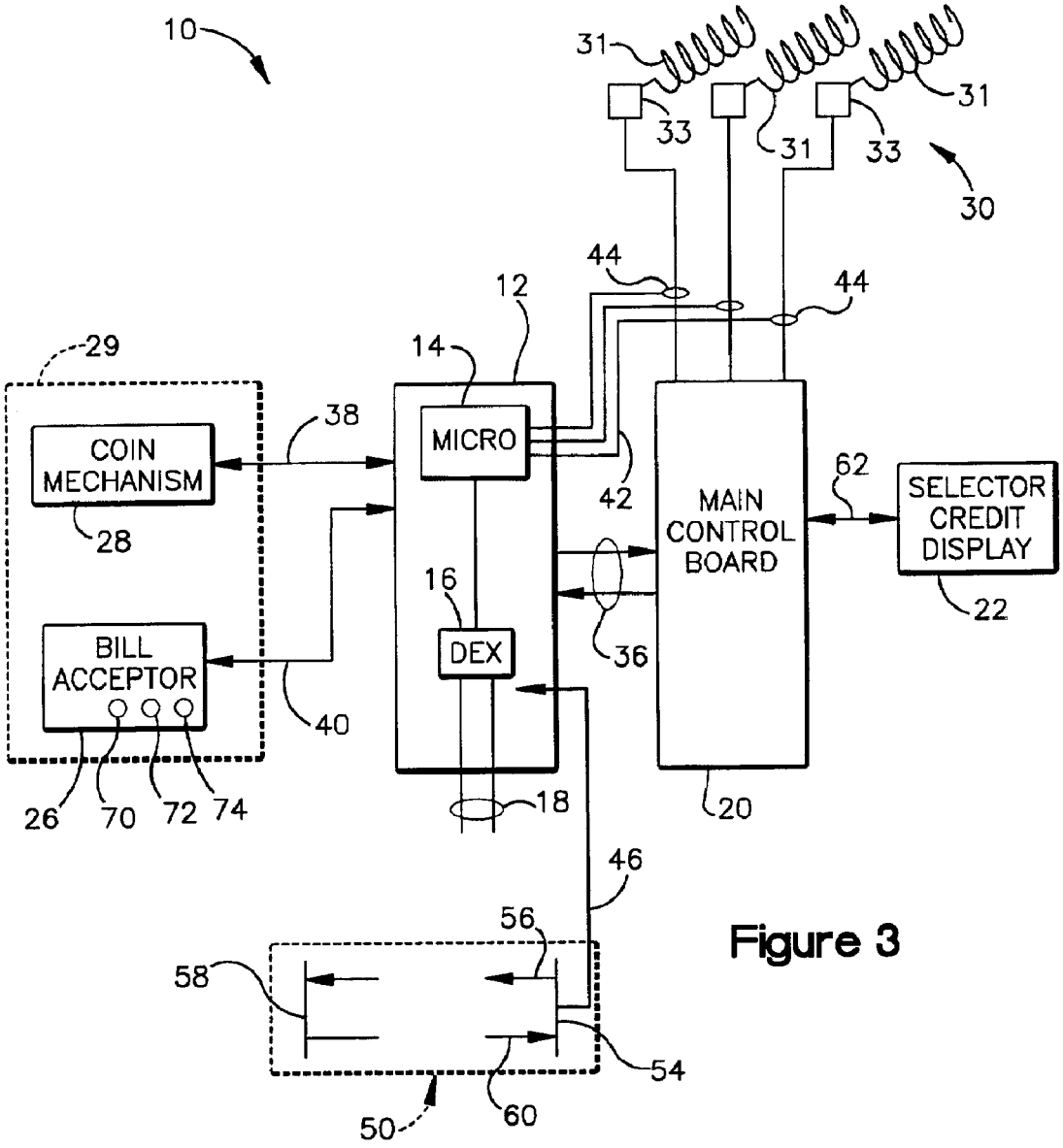
FIG. 3 is a schematic representation of the audit monitoring and product drop system of the present invention as retrofitted in the Automatic Products Co. Snack Shop 7000 vending machine of FIG. 1 using a Mars Series 4000 Coin Changer and a Mars Series 2000 Bill Acceptor.

An audit monitoring and product drop system 10 for retrofit into an existing vending machine is disclosed in the figures and more particularly in FIG. 3. The embodiment disclosed herein is particularly adapted to retrofit prior art Snack Shop 7000 Automatic Products Co. vending machines with an audit monitoring and product drop system 10, a new coin changer 26 and a new bill acceptor 28.

Retrofit of existing vending machines with new controls is important to adapt existing prior art machines to new technology. New coin changers are required with the increased use of the dollar coin along with nickels, dimes and quarters. The new coin changers or coin mechanisms accept, dispense and store four different coins, i.e., nickels, dimes, quarters and the new Susan B. Anthony dollar coin versus many older coin changers which only accept, dispense and store three coins, i.e., nickels, dimes and quarters. The present invention will be disclosed utilizing a Mars coin changer Series 4000 manufactured by Mars Electronics International, which utilizes four coin tube cassettes, not illustrated, and allows the possibility to dispense the "Susan B. Anthony" dollar coin. In the present embodiment the coin changer may be a VN 4000 Model Series 4000 utilizing a 110 volt MicroMech coin changer or a VN 4010 XV Model Series 4000 utilizing a 24 volt MicroMech coin changer both of which are manufactured by Mars Electronics International. However, it should be apparent that it is within the scope of the present invention to use other coin changers, but that the software and interfaces disclosed herein may require modification by one of ordinary skill in the art.

The bill acceptor for use in the present invention is preferably a Mars Bill Acceptor 2000 which can include Mars model VN 2300 designed to accept one and two dollar bills or the VN 2500 which is designed to accept one, two and five dollar bills (both new and old five dollar bills).

The operation of the Mars Coin Changer Series 4000, the Mars Bill Acceptor Series 2000 and Snack Shop 7000 vending machines are well known and are disclosed in the Mars Coin Changer Series 4000 Operation and Service Guide, the Mars Bill Acceptor Series 2000 Operation and Service Guide and the Snack Shop 7000 Instruction Manual which are incorporated herein by reference.

It should be appreciated that the present audit monitoring and product drop system 10 could be utilized to retrofit prior art vending machines other than the Automatic Products Snack Shop 7000 and could be utilized to interface with other than a Mars Series 2000 Bill Acceptor or Mars Series 4000 Coin Changer by the modification of software and the interconnecting wiring harnesses. Accordingly, it is well within the scope of the present invention to use the present audit monitoring and product drop system to retrofit other vending machines and the use with the Snack Shop 7000 and the Mars Bill Acceptor and Coin Changer is for illustrative purposes only.

Figure 1:
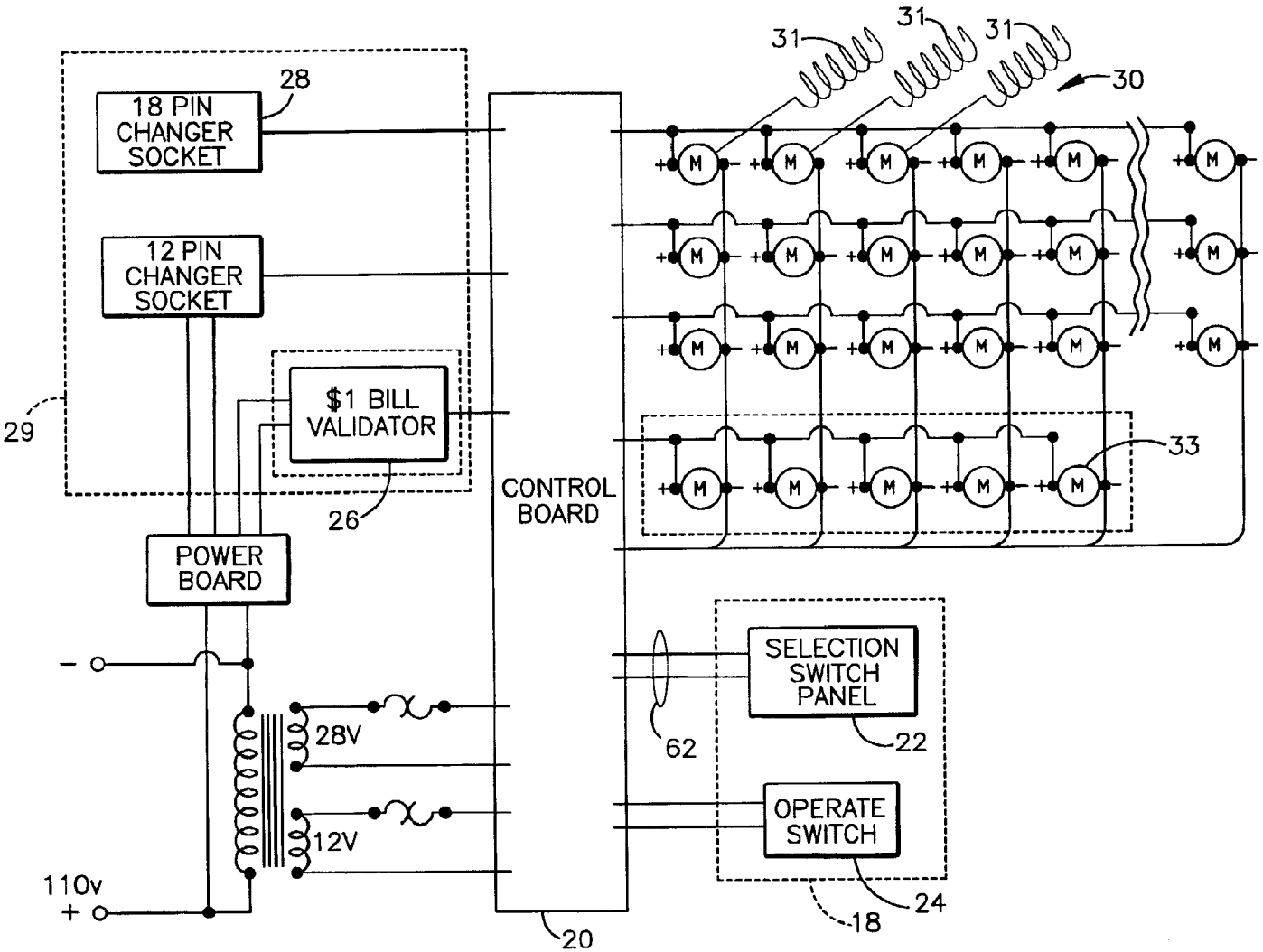
FIG. 1 is a schematic representation of a prior art control for a Snack Shop 7000 vending machine manufactured by Automatic Products Co. of St. Paul, Minn.

As is illustrated in FIG. 1 which discloses a schematic diagram of an unmodified Snack Shop 7000, the Snack Shop 7000 vending machine includes a main control board 20 which controls operation of the vending machine. Connected to the main control board 20 is a product selector mechanism 18 including a selection switch panel/credit display 22 and an operating switch 24. The selection switch panel/credit display 22 allows a customer to make a particular product selection which is generally numbered or alphabetically labeled in a well known manner and also displays the amount of funds entered into the machine or any credits available. A bill acceptor 26, a coin changer 28 and a plurality of product dispensing mechanisms 30 each of which is adapted to dispense a particular product is connected to the main control board 20. The operating switch 24, when actuated, effects energization of a particular selected product dispensing mechanism 30 to dispense the product selected by the customer. In some machines, the operating switch 24 can be combined into the selector switch panel 22 so that when the selection is completed, the machine will automatically actuate the selected product dispensing mechanism 30 without operation of an additional operator switch 24.

A customer who desires to purchase a particular product inserts coins into the coin mechanism 28 and/or bills into the bill acceptor 26 and a credit is provided on the credit display of the selection switch panel 22 by the control board 20. The customer then makes his selection on the selection switch panel 22, which causes the main control board 20 to energizes one of the product dispensing mechanisms 30 to dispense a particular product associated with the selected product dispensing mechanism 30 as selected by the selection switch panel 22. When the product dispensing mechanism 30 is energized by the main control board 20, a product is dispensed and then the control board 20 instructs the coin changer 28 to return the correct change to the customer. For example, if a dollar bill is entered into the bill acceptor 26 and a fifty cent item is selected by the selection switch panel 22, after the item is vended, the control board 30 will instruct the coin changer 28 to dispense fifty cents in change.

In the Automatic Product Snack Shop 7000 vending machine, a plurality of wire spirals schematically illustrated at 31 are utilized to store and dispense products. Each of the product dispensing mechanisms 30 include a spiral associated therewith and a motor 33 which rotates the spiral 31 when the motor 33 is energized in a well known manner to dispense products disposed in the spaces between the spirals 31. Missed vends sometimes occur when the motor 33 is energized to rotate its associates spiral 31 and dispense its associated product. In some instances, the motor 33 is energized, the spiral 31 is rotated and a product is not dispensed. In such a situation, the prior art vending machines such as the Snack Shop 7000 could not sense that a product had not been dispensed, and according the machine would go through its normal vend cycle and dispense any change required even though a product was not dispensed resulting in customer dissatisfaction. Accordingly, it is desirable to positively sense a product dispensation to ensure customer satisfaction and to ensure that either a product is dispensed or the customer's money is refunded. In addition, it is desirable to add audit monitoring capability to the vending machine to keep track of transaction information including the money associated with the product transactions and the products vended, and to store same for future reference. However, it is only desirable to keep track of transaction information if a product has been vended because a non-sensed miss-vend will result in inaccurate transaction information.

The audit monitoring and product drop system 10 as disclosed in FIG. 3 includes a control unit 12 which interconnects the coin mechanism 28 and the bill acceptor 26 with the main control board 20 of the vending machine. Generally, during the retrofitting process, the original coin mechanism of the Snack Shop 7000 vending machine is replaced with a new updated coin mechanism 28 such as the Mars Coin Changer Series 4000 which accepts dollars, quarters, dimes and nickels and the bill validator, if one was present in the original vending machine, is replaced with a new updated bill validator such as the Mars Series 2000 Bill Acceptor which accepts one dollar bills, two dollar bills and new and old five dollar bills. The original bill validator in the Snack Shop 7000 vending machines, if one was present, generally only accepted dollar bills. Additionally, if no bill acceptor was present in the vending machine, one can be added during the retrofit.

The means for receiving funds and dispensing change 29 includes the coin changer 28 and the bill acceptor 26. However, in some cases, a bill acceptor 26 is not utilized and only a new coin mechanism 28 and new control unit 12 are utilized to update the vending machine. Thus, the reference to the means for receiving funds and dispensing change 29 includes the coin mechanism 28 and bill acceptor 26 or solely the coin mechanism 28 if no bill acceptor is utilized.

The control unit 12 receives communications from the means for receiving funds and dispensing change 29, communicates therewith and communicates with the main control 20 of the vending machine. The control unit 12 interrupts the normal communication between the main control board 20, the bill acceptor 26 and the coin mechanism 28, processes such communication signals and then reformats and resends them to the bill validator 26, coin mechanism 28 and main control 20 to control operation of the vending machine, the bill validator and the coin mechanism 28.

Figure 4:
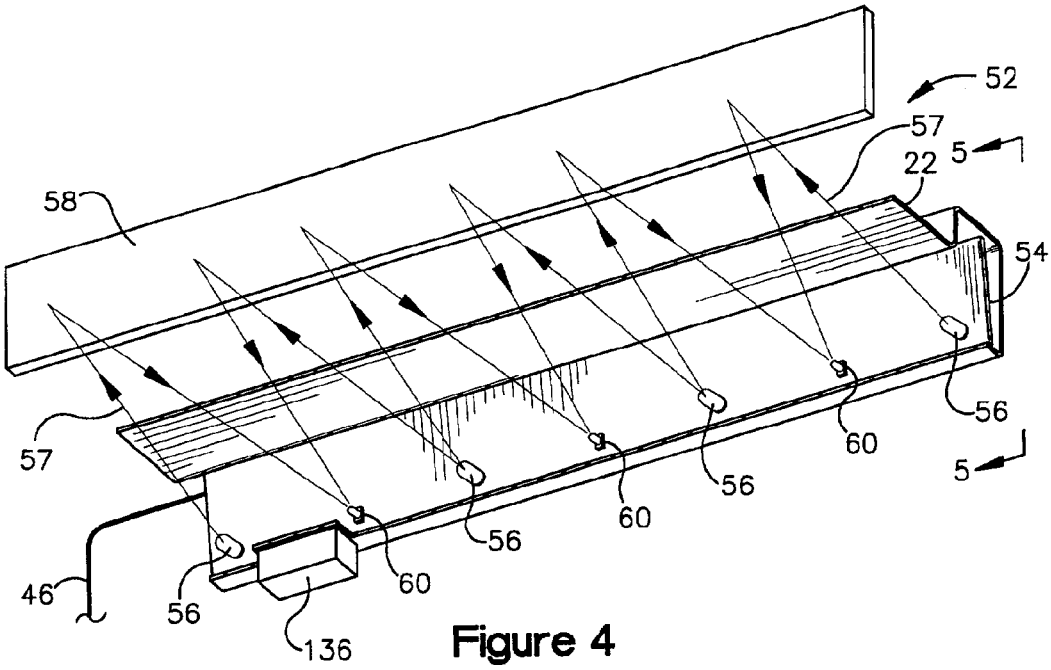
FIG. 4 is a schematic representation illustrating the product drop sensor and the emitted radiation as retrofitted into the product drop area of an existing vending machine.
Figure 6:
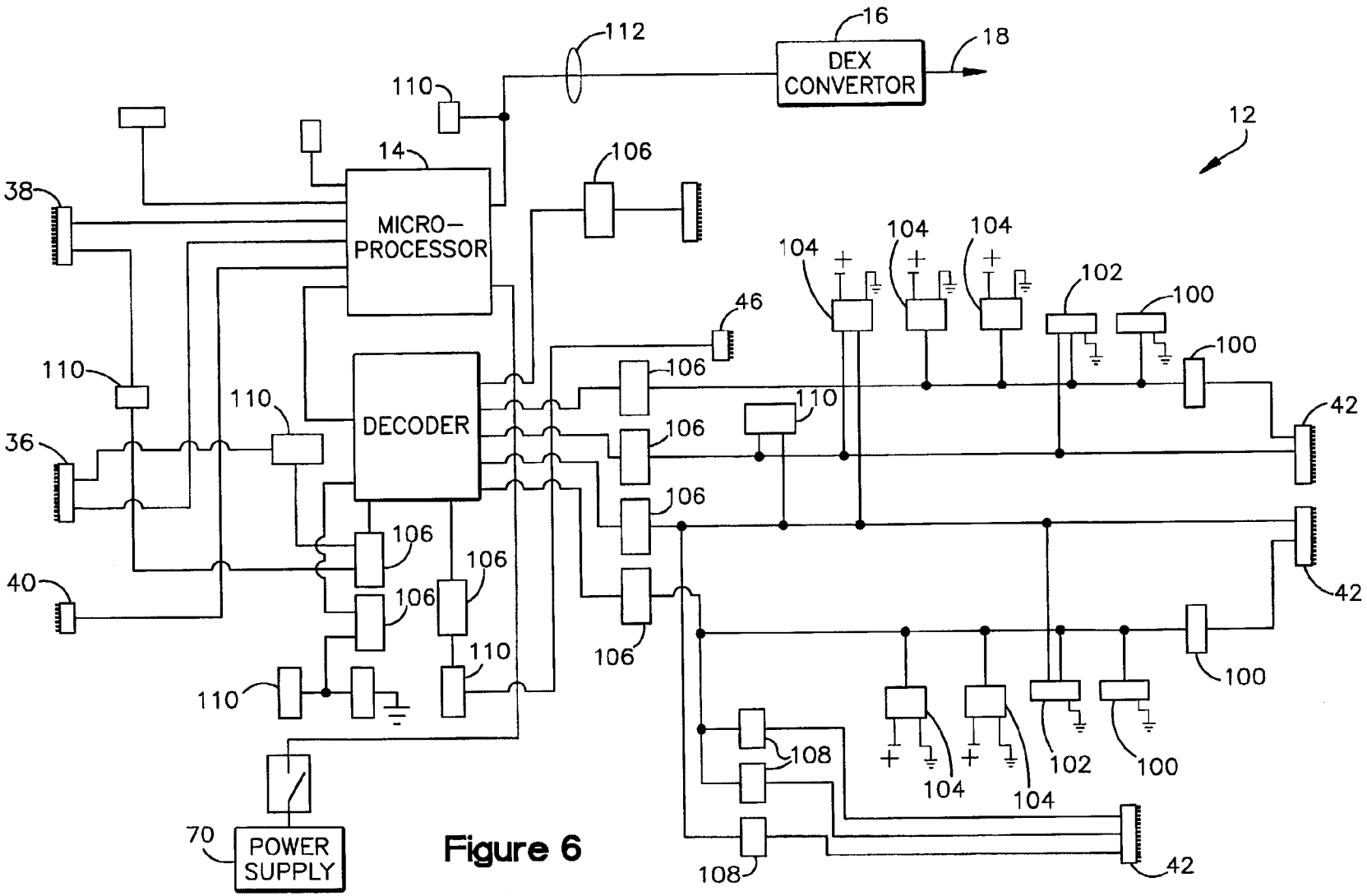
FIG. 6 is a schematic representation of the control circuitry for the control unit 12.
Figure 7A:
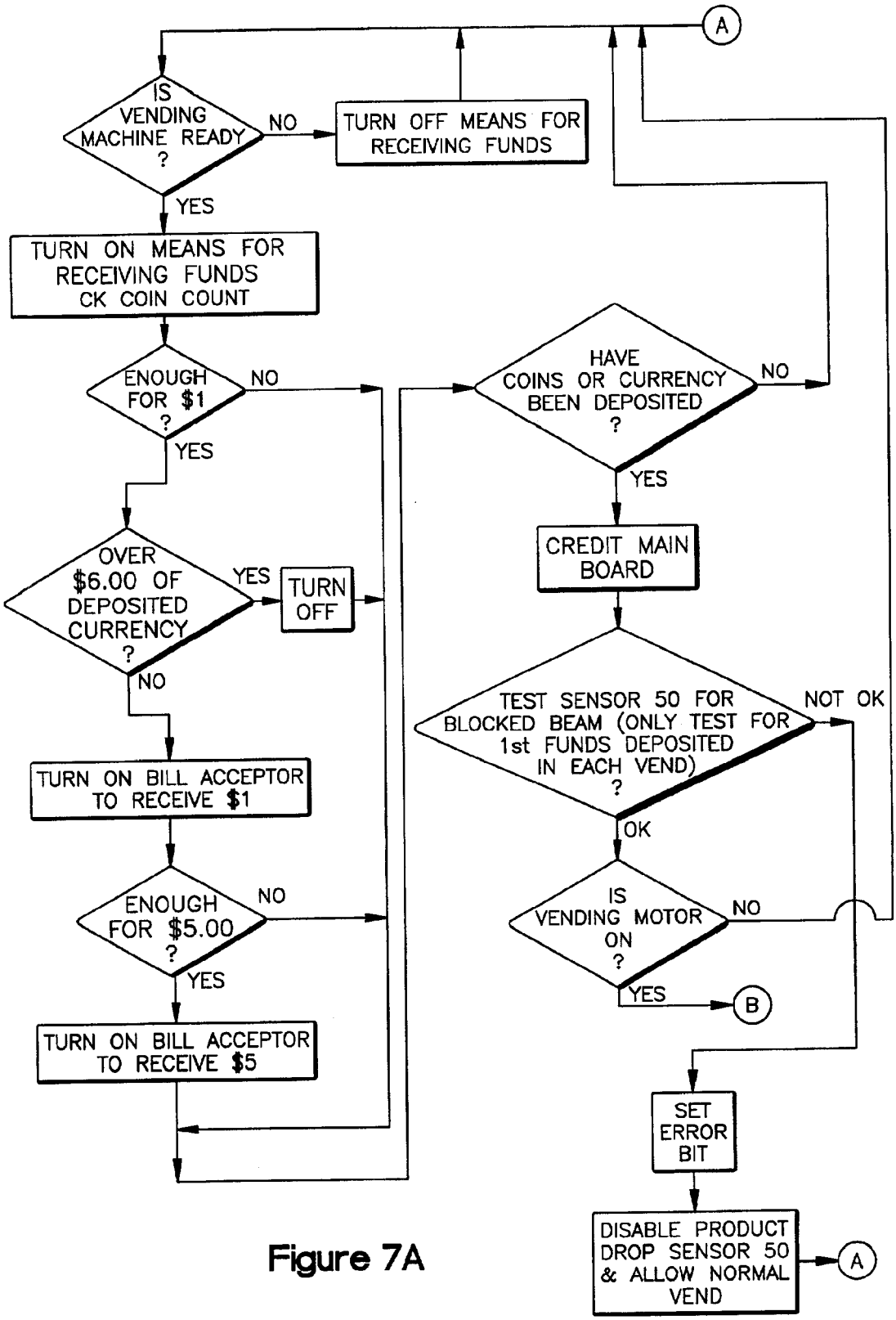
FIG. 7 is a flow chart illustrating the operation of a vending machine retrofitted with the product drop sensor of the present invention.
Figure 7B:
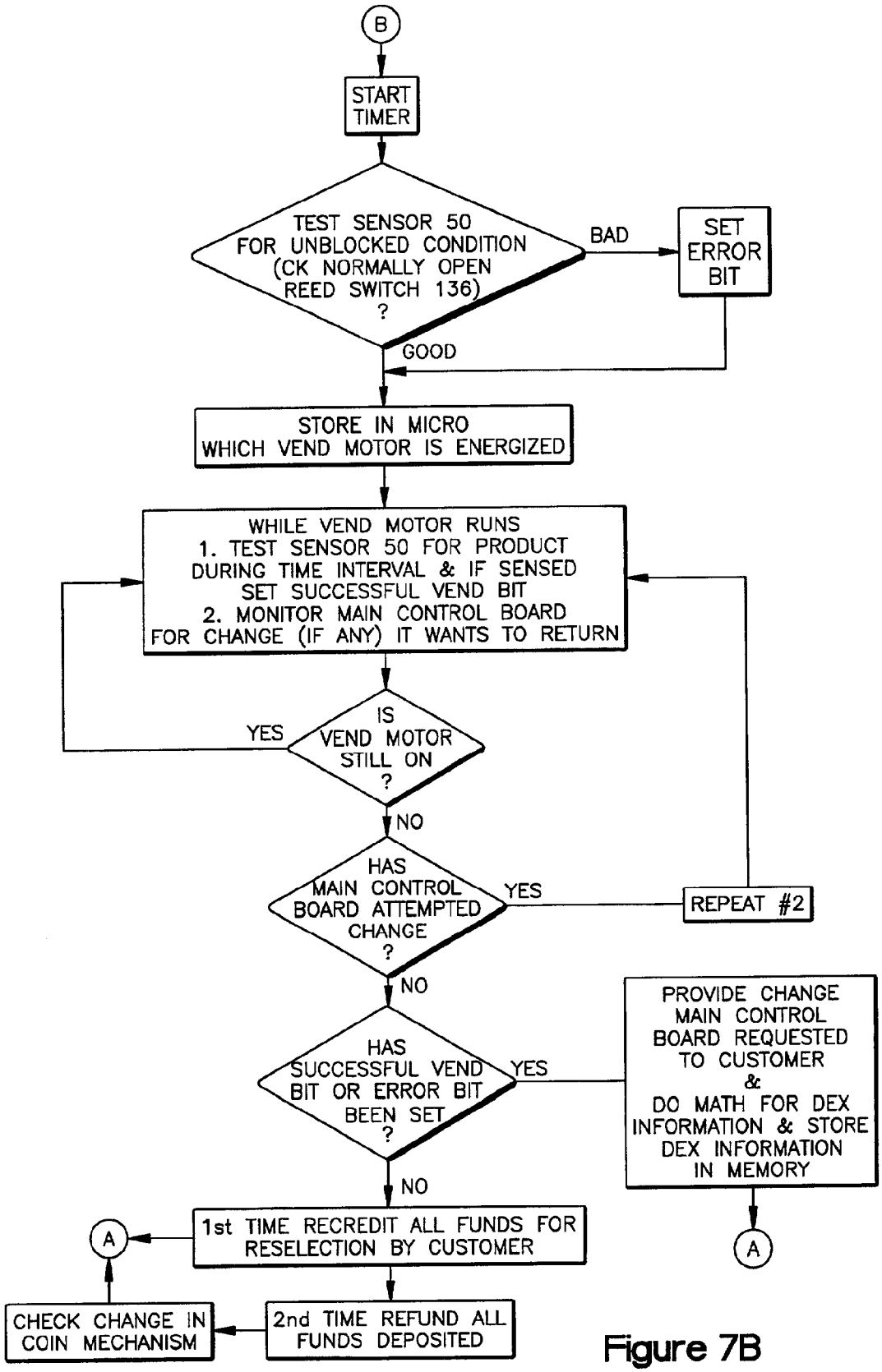

The control unit 12, illustrated as a block diagram in FIG. 4 and schematically illustrated in more detail in FIG. 6, includes a microprocessor 14 which communicates with the bill acceptor 26, coin mechanism 28 and main control board 20 and a memory 16 for storing transaction data such as total amount vended, products dispensed by particular product, funds disposed in the cash box, and funds by denomination in the coin mechanism 28. The memory 16 includes an output 18 for outputting information from the memory 16. The output 18 can be any one of a variety of well known outputs such as a hard wired output, radio communication or infrared signals. In a preferred embodiment, a Palm Pilot or other hand held device is utilized to download information from the memory 16. The memory 16 is preferably configured in a DEX standard which is a standard for storing transaction data which has been established by the European Vending Association. The memory 16 can be provided on a separate circuit board which plugs into the control unit 12 circuit board to enable use of the control unit 12 without a memory 16 if desired.

The control 12 as is illustrated in more detail in FIG. 6, is connected to the main control board 20 by a wiring harness 36 which transmits electrical signals to and from the main control board 20 and the microprocessor 14 of the control unit 12. Likewise, a wiring harness 38 interconnects the coin mechanism 28 and the control unit 12 to enable the microprocessor 14 to receive and transmit electrical signals to and from the coin mechanism 28 and a wiring harness 40 interconnects the bill acceptor 26 and the control unit 12 to allow the microprocessor 14 to transmit and receive electrical signals to and from the bill acceptor 26. The control board includes a plurality of inputs 42 each of which are connected to a sensor 44 (see FIG. 4) which senses energization of a particular motor 33. The inputs 42 pass through resistor packs 100, capacitor packs 102 and diode packs 104 which condition the input signals on lines 42 and pass the input signals through interfaces 106 to the microprocessor 14 where they are processed. Optocouplers 108 can be provided for signal isolation and various additional resistor packs 110 can be provided to condition the output signals from the microprocessor 14.

The microprocessor 14 may be connected to a memory 16 via lines 112 which preferably is a DEX converter which converts information from the microprocessor 14 and stores it in DEX format where it can be downloaded via the output 18 upon demand. The control unit 12 also includes an input 46 from a product drop sensor, more fully described herein below. The input 46 from the product drop sensor 50 conditions the microprocessor 14 to dispense the correct change from the means for receiving funds and dispensing change 29 and enables the microprocessor 14 to download information to the DEX converter and memory 16 to store transactional data only if a product passes through the product drop area.

Each product dispensing mechanism 30 includes a sensor 44 connected to the conductors for energizing each of the motors 33 of the product dispensing mechanism. Each of the sensors 44 are preferably voltage sensors 44 which are connected by the line 42 to the control unit 12. When one of the motors 33 is energized, the voltage sensor 44 associated therewith establishes a signal which is directed over the line 42 to the microprocessor 14 to indicate energization of a particular motor 33 with which a particular product to be dispensed is associated. While voltage sensors 44 have been illustrated as sensing the actuation of each of the product motors 33, other types of sensors such as current sensors, video sensor, or motion sensors could be utilized to sense energization of a particular motor 33 or motion of a particular spiral 31. When a motor 33 is energized by the main control board 20, a signal is sent to the microprocessor 14 over line 42 indicative of which motor 33 is energized. Energization of a particular motor 33 is indicative of the attempted dispensing of a particular product associated with the particular energized motor. Thus, energization of a particular motor 33 sends information to the microprocessor 14 which is indicative of a particular product to be dispensed.

Figure 2:
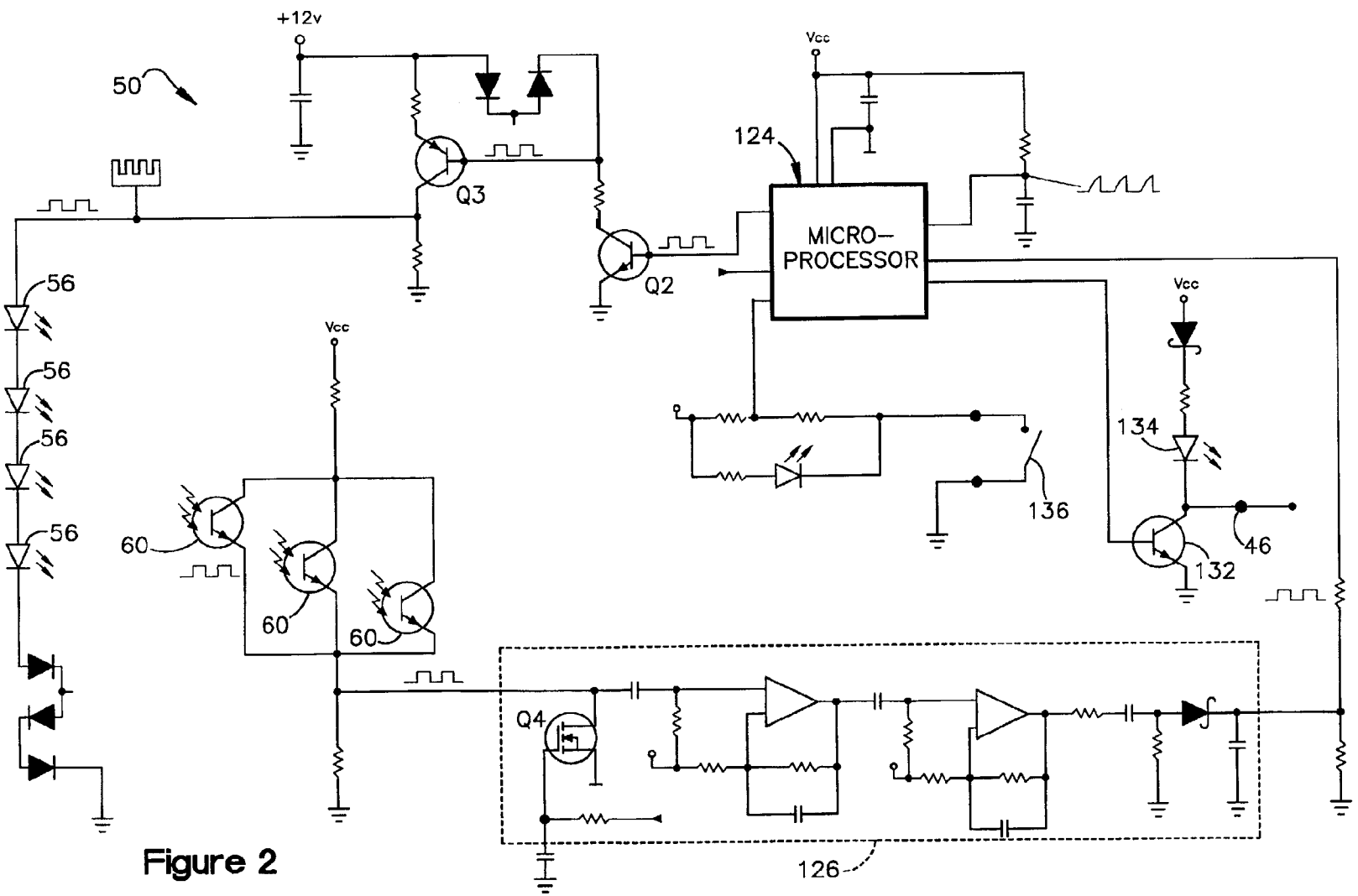
FIG. 2 is a schematic representation of the product drop sensor.

A product drop sensor 50, more fully illustrated in FIGS. 2 and 4, is utilized to positively sense the dispensation of a product. In the Snack Shop 7000 vending machine and in many other vending machines, product to be dispensed is disposed vertically above a product drop area 52. When a particular product to be dispensed is selected, the motor 33 associated with the selected product dispensing mechanism 30 is actuated and the product is dispensed from a product shelf, not illustrated, generally via a spiral 31 in a well known manner where the product drops in a vertical downwardly direction through the product drop area 52, schematically illustrated in FIG. 4, where the dispensed product can be retrieved by a customer. The product drop sensor 50 is connected via a lines 46 to the control unit 12 to transmit electrical signals to the microprocessor 14 indicative of a product drop. The product drop sensor 50 is particularly adapted for retrofit into an existing vending machine adjacent a product drop area 52 to sense passage of a dispensed product therethrough. The product drop sensor 50 is a substantially unitary structure which includes circuit board 54 which is connected via the lines 46 to the control unit 12.

The circuit board 54 includes a plurality of electromagnetic radiation emitting elements 56 which in the preferred embodiment are light emitting diodes emitting electromagnetic radiation in the IR range, but which could be other types of electromagnetic radiation sources such as visible light. Each of the light emitting diodes 56 emit a beam 57 of electromagnetic radiation which diverges at approximately a 20 degree angle from the center of each light emitting diode 56. The beam 57 of electromagnetic radiation from each of the light emitting diodes 56 is directed across the product drop area 52 toward a reflector 58 which is disposed on the opposite side of the product drop area 52. The reflector 58 may be constructed on a self adhesive tape so that the reflector 58 is readily affixed to a flat surface on the vending machine adjacent the product drop area 52 opposite to board 54. It has been found that a retroreflective sheeting such as manufactured by 3M and sold as 3M Scotchlite Photoelectric Grade Sheeting 7590 is adequate to reflect the beams of electromagnetic radiation from light emitting diodes 56 back across the product drop area 52 toward the circuit board 54. The 3M retroreflective sheeting is a flexible, wide angle, smooth surface, retroreflective sheeting designed for use in photoelectric applications.

A plurality of electromagnetic radiation detectors 60 are located on the circuit board 54 interposed between the light emitting diodes 56 to sense electromagnetic radiation which is reflected from the reflective tape 58 back toward the board 54. When a product drops through the product drop area 52, the electromagnetic radiation beams 57 from the light emitting diodes 56 are interrupted by the passage of the product and the reflected radiation from the reflective tape 58 to the detectors 60 is also interrupted by the passage of the product through the product drop area 52, the detectors 60 sense a reduction in electromagnetic radiation, and the detectors 60 send a signal over the wiring harness 46 to the microprocessor 14 that a product drop has occurred. The circuit board 54 has a length which is substantially coextensive with the width of the product drop area 52 to enable the beams 57 of electromagnetic radiation and reflected electromagnetic radiation to cover enough of the product drop area 52 to ensure that a product drop through the product drop area 52 disrupts the electromagnetic radiation being sensed by the detectors 60. The board 54 additionally has a planar substantially unitary construction which allows easy mounting in an existing vending machine. The wiring lines 46 from the board 54 needs to be connected to the main control unit 12. Since the detectors 60 and emitters 56 are both located on circuit board 54 on the same side of the product drop area 52, no wiring is required on the opposite side of the product drop area 52 at the location of the reflector 58, thus simplifying retrofit of an existing vending machine.

Figure 5:
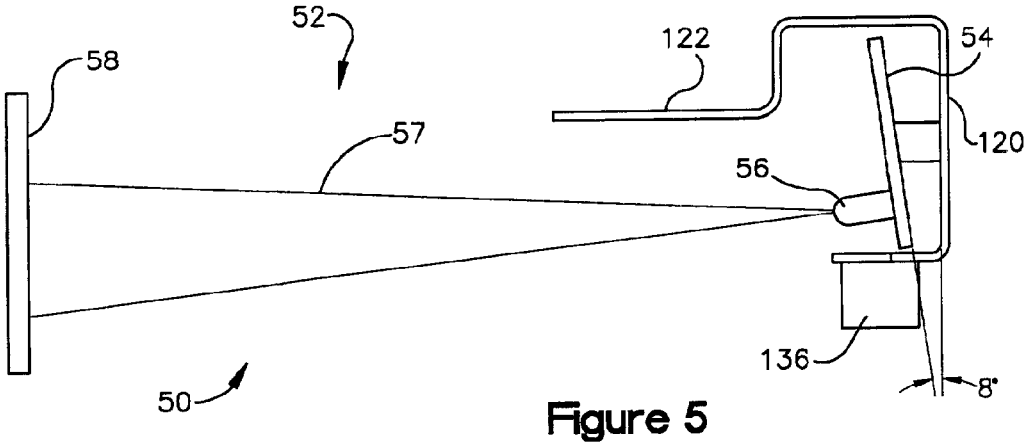
FIG. 5 is a cross-sectional view taken approximately along lines 6—6 of FIG. 5 illustrating the mounting of the sensor board and the shielding thereof.

The board 54 of the product drop sensor 50 is preferably disposed in a channel member 120, more fully illustrated in FIG. 5, which can be affixed to the inside of the vending machine adjacent the product drop area 52 by fasteners or adhesive, not illustrated. The channel 120 includes a shield 122 on the upper portion thereof which projects into the product drop area 52 and which shields the product drop board 54, including the emitters 56 and detectors 60 from ambient light present in the product drop area 52. Additionally, the channel supports the board 54 generally in a vertical orientation which is skewed in a downwardly direction as viewed in FIG. 5, approximately 8 degrees from vertical to improve the performance of the product drop sensor 50 and reduce the influence of ambient light.

To improve the performance of the product drop sensor, a pulsed beam of electromagnetic radiation in the infrared range can be utilized to minimize the effects of ambient light on the product drop sensor 50. The product drop sensor 50, as is more fully illustrated in FIG. 2, includes a microprocessor 124 which establishes a pulse train to transistors Q2 and Q3 to energize the light emitting diodes 56 with a square wave of a known predetermined frequency. The LEDs 56 then establish pulses of infrared radiation across the product drop area 52 having a frequency equal to the frequency of the square wave which are reflected by the reflector 58 and directed back toward the detectors 60. The detectors 60 sense the pulses of IR radiation and additionally sense ambient light present in the product drop area 52. The output of the detectors 60 is combined and directed through a filtering circuit 126 to an input of the microprocessor 124. The filtering circuits 126 remove the effects of ambient light from the output of the detectors 60. The filtered signal from the detectors 60 is directed to an input of the microprocessor 124 where it is compared to the reference frequency established at the microprocessor 124. The microprocessor ensures that the pulsed electromagnetic radiation received by the detectors is the pulsed electromagnetic radiation established by the emitters 56 to reduce the effects of ambient radiation. When a product drops through the product drop area 52, the product interrupts the beams of electromagnetic radiation, the amount of electromagnetic radiation reaching detectors 60 decreases and if the decrease in electromagnetic radiation sensed is of the correct frequency, the microprocessor 124 will establish an output on the line 130 which switches transistor 132 to its off condition which establishes a positive drop pulse on line 46 which is directed to the control board 12. A red LED 134 is connected to the transistor 132 and is normally illuminated to show that the product drop sensor 50 is working.

A reed switch 136 may be disposed on the bottom of the channel 120 in which the circuit board 54 is located. The reed switch 136 is a normally open read switch and is operable to come into proximity with a magnet, not illustrated, which is disposed on a door (not illustrated) to the product drop area. It is well known to provide a pivotable door to limit access to the product drop area 52. When the door is pivoted to its open position, the magnet mounted on the door comes in close proximity to reed switch 136 to closes normally open reed switch 136 to send a signal to the microprocessor 124 to prevent a product drop from being recorded or being sensed when the door is opened. Additionally, if the door is open and the normally open reed switch is closed the drop sensor 50 will be disabled.

The LED 134 is normally energized and the output thereof is detected by detectors 60. When the first coin is placed into the coin mechanism 28, a signal is sent from the control unit 12 to the product drop sensor 50 which checks the sensor 50 for operability and extinguishes LED 134 if the sensor is operable. If the sensor 50 is not operable, the microprocessor 124 will shut off the product drop sensor 50 and allow the machine to vend in a normal fashion as if the product sensor 50 were not present. This checking circuit prevents false readings and prevents false no product vend signals. As an additional test to prevent false product drop signals, as soon as a product vend motor 33 is energized, the product dropped sensor 50 checks the output of the detectors 60 at the microprocessor 124 to determine if the detectors 60 are receiving the correct square wave signal from the emitters 56. If the microprocessor senses that the correct signal is being sensed, the product drop sensor 50 is enabled. If an incorrect signal is sensed, the product drop sensor is disabled and the vending machine is allowed to vend in a normal fashion as if a product drop sensor were not present. When the vending machine operates in a normal fashion, the product drop sensor 50 will be shut off and the control unit 12 will assume that when a product dispensing mechanism 30 is actuated a product is dispensed, whether or not the product is dispensed and will instruct the means for receiving funds and dispensing change 29 to provide the change calculated by the main control board 20. This prevents a broken product drop sensor 50 from shutting down the entire vending machine.

When it is desired to dispense a product, a customer enters funds into the means for receiving funds and dispensing change 29 which funds are equal to or greater than the cost of the item to be selected. The funds can be entered in the coin mechanism 28 and/or the bill validator 26. An electrical signal indicative of the funds received in the means for receiving funds and dispensing change 29 is sent to the microprocessor 14 which sends a signal to the main control board 20 indicative of the funds received. The main control board 20 sends a signal to the selector switch/credit display 18 indicative of the funds received which is displayed on the credit display. The customer then makes his selection via the selector switches/credit display 22 which sends a signal to the main control board 20 to energize a particular product dispensing mechanism 30 and its associated motor 33 and which allows the main control board to calculate the correct amount of change. The correct change is calculated using the funds inputted and the price of the item vended and is sent from the main control board 20 to the microprocessor 14 of control unit 12 for storage for later use. The motor 33 is energized and an associated actuator, which in the preferred embodiment is the spiral 31, associated with the motor 33 rotates to dispense a product in a well known manner. The control unit 12 is operable to sense via sensors 44 which particular motor 33 is energized and upon energization of a particular motor 33 a timer in the microprocessor 14 of control unit 12 is energized. When a motor 33 is energized and the timer is started, the microprocessor 14 is instructed to look at the signals from the product drop sensor 50 to determine if a product has been dropped through the product drop area 52. A product must be dropped before the timer times through a predetermined time period. Assuming a product drop is sensed, the product drop sensor 50 sends a signal to the microprocessor 14 indicative thereof. The control unit 12 then sends a signal (which has been previously stored in microprocessor 14) via lines 38 to the means for receiving funds and dispensing change 29 to cause the correct change to be dispensed. After a product drop is sensed, the transaction data from the microprocessor 14 is stored in the memory 16 for further use.

If a motor 33 is energized to dispense a particular product and the predetermined timing period initiated by actuation of the motor 33 in the microprocessor 14 expires before a product drop is sensed by the product drop sensor 50, the microprocessor 14 will send a signal to the main control board 20 to re-credit any funds received by the means for receiving and dispensing change 29. The funds will be credited on the selector switch/credit display 22 and the customer will be allowed to reselect merchandise to be vended. If the customer makes the same selection and a product drop is again not sensed by the product drop sensor 50, the microprocessor 14 will instruct the means for receiving funds and dispensing change 29 to refund any funds received in the means for receiving funds and dispensing change 29. If a product drop is sensed on the second actuation of a particular motor 30, the microprocessor 14 will then send a signal to the means for receiving funds and dispensing change 29 to dispense the correct change.

The control unit 12 is operable to communicate with the coin mechanism 28, bill acceptor 26, product sensor 50, motor voltage sensors 44 and the main control board 20 of the vending machine. The signal from the motor sensors 44 and the product drop sensor 50 are essentially one way signals to the control unit 12 to send information indicative of a motor actuation (product information) and a product drop. The control unit 12 interrupts, stores, and resends the electrical signals between the bill acceptor 26 and coin mechanism 28 and the main control board 20 and also forwards transaction data to the memory 16.

When funds are received in the means for receiving funds and dispensing change 29, a credit signal is sent to the microprocessor 14 from the bill acceptor indicating bills in by denomination and bills in the cash box of the bill validator and a signal is also sent to the microprocessor 14 from the coin mechanism 28 indicative of change in by denomination and change available to be dispensed by denomination in the coin mechanism 28. The credit signals of funds is sent from the microprocessor 14 to the main control board 20 of the vending machine to indicate on the selector switch/credit display 22 the credit available. The main control board 20 is further operable to send signals to the control unit 12 indicative of a vending machine problem in which case, the main control board 20 will send a signal to the microprocessor 14 to tell the microprocessor 14 to shut down or inhibit the coin mechanism 28 and bill acceptor 26 to prevent the receipt of funds if a problem is sensed by the main control board 20. An inhibit signal to the means for receiving funds and dispensing change 29 is also established by the main control board 20 when the highest price for an item to be vended has been entered into the means for receiving funds and dispensing change 29, i.e., if the highest priced item to be vended is a one dollar and fifty cent items, the main board will send a signal to the microprocessor 14 when one dollar and fifty cents or greater has been entered into the means for receiving funds and dispensing change 29 to inhibit the bill acceptor 26 and coin mechanism 28 from receiving further funds. The main control board 20 is further operable to send a signal to the control unit 12 indicative of the change to be dispensed by denomination. This signal is stored in the microprocessor 14 and is not sent to the coin mechanism 28 until product drop sensor 50 sends a signal to the control unit 12 indicative of the occurrence of a product drop. This prevents incorrect change from being dispensed if a miss-vend occurs. The coin mechanism 28 is operable to send electrical signals to the microprocessor 14 indicative of change available to be dispensed by denomination in the coin mechanism 28. This information is sent by the microprocessor 14 to inhibit use of the bill acceptor 26 if the correct amount of change is not available to be dispensed in the coin mechanism 28.

The bill acceptor 26 includes a plurality of indicators 70, 72 and 74 which are indicative of the bills which are acceptable to the bill acceptor 26. For example, indicator 70, which may be a LED which is lit to indicate that all bills are acceptable, i.e., one dollar, two dollar, and five dollar bills, the indicator 72 is indicative that only one dollar bills are acceptable and the indicator 74 is energized if no bills are acceptable. Additionally, an indicator light may be provided on the outside of the bill acceptor 28 to indicate the status of the bill acceptor 26 when it is processing currency.

Information in microprocessor 14 is periodically forwarded to the memory 16 to keep track of transaction information including products dispensed, total amount vended and funds in the means for receiving and dispensing change 29. This information may include bills in by denomination, bills in the cash box, change in the cash box and change available to be dispensed by denomination. As indicated hereinabove, this information is preferably stored in a DEX format in memory 16 where it can be downloaded to a portable terminal on demand.

The method of operating a vending machine using the audit monitoring and product drop system 12 of the present invention is more fully disclosed in the flow chart of FIG. 8 which illustrates the operation of a vending machine retrofitted with the product drop sensor 50 of the present invention. The vending machine control 12 polls the main control board 20 to determine if the vending machine is ready to vend. If the vending machine is not read to vend, the control 12 turns off the coin mechanism 28 and bill validator 26. If the vending machine control determines that the vending machine is ready, the control 12 will turn on the coin mechanism 28 and bill validator 26. The control 12 then checks the coin count to determine if there is enough change for a dollar bill. If there is not enough coins, the coin changer will check if coins or paper have been deposited, in which case, the control 12 will wait until the coins or paper have been deposited to again determine if there are enough coins to dispense change. In addition, the control 12 will turn off the bill validator 26 if more than $6.00 has been deposited in paper as there are no items in the vending machine which cost more than $6.00. If there are enough coins for a dollar change, the coin changer will turn on the bill acceptor LED 22 which is indicative of the bill acceptor 26 being able to accept dollar bills. If there is enough change for five dollar bills, the control unit 12 will turn on the LED 70 indicating that the bill acceptor can accept one, two, and five dollar bills. The coin mechanism 28 and the bill acceptor 26 will transmit signals to the control 12 indicative of funds deposited and the control unit 12 will retransmit such signals to the main control board 20 of the vending machine. When the first coin or first dollar bill is deposited in the means for receiving funds and dispensing change 29, the product drop sensor 50 will be tested to determine if any of the light emitting diodes 56 are blocked, in which case the product drop sensor 50 will be disabled and the vending machine will be allowed to operate in a normal vend mode. Assuming the emitters 56 are not blocked, the control unit 12 will then wait until it senses if any of the vend motors 33 have been energized. If a vend motor is turned on, product drop sensor 50 is again tested to determine if it is unblocked and ready. If it is bad due to a bad sensor or the door to the product drop area 52 being held open, a normal non-product sensed vend procedure will occur. If the test on the product drop sensor 50 indicates it is unblocked and ready, the control 12 will record which motor 33 is energized by which sensor 44 sends a signal to the microprocessor 14. Actuation of any motor 33 will cause microprocessor 14 to initiate its internal timer to set the timing period during which the microprocessor 14 senses the output of the product drop sensor 50. If a product drop is not sensed during the timing period, a credit will be provided and no transactional information will be downloaded to memory 16. While the motor 33 is running, the control unit 12 monitors the product drop sensor 50 for a successful vend indication and receives a signal from the main control board 20 indicative of change required. Once the motor stops the control 12 determines whether the main control board 20 has attempted to make change. If the main control board 20 has attempted to make change, the control 12 monitors the main control board 20 to determine the amount of change to return. If a successful vend has been sensed or an error bit has been set to disable the product drop sensor 50, the control 12 will instruct the means for receiving and dispensing funds 29 to dispense the correct change and do the appropriate math for the DEX information to be stored in the DEX memory 16 for the particular sensed transaction. If a successful vend has not been sensed or an error bit has not been set, then the customer will receive a credit for his money at the selector credit display mechanism 22. The control unit 12 will send a signal to the main control board 20 to cause the main control board 20 to re-credit the money deposited by the customer. The customer will then be allowed to pick another item or to attempt to re-vend the previously selected item. If a successful vend bit has not been sensed on the second successive vend of the previously selected item, the customer will be returned all his money via the means for receiving funds and dispensing change 29.

From the foregoing, it should be apparent that a new and improved audit monitoring and product drop system 10 adapted to retrofit into an existing vending machine having a product selection switch/credit display 22, a main control board 20, and a plurality of product dispensing mechanisms 30, each of which is operable to dispense a particular product through a product drop area 52 has been disclosed. Each of the product dispensing mechanism includes motor 33 which in the preferred embodiment is connected to a spiral 31 which when rotated dispenses a particular selected product through the product drop area 52. The vending machine includes a means for receiving funds and dispensing change 29 which includes a coin mechanism 28 and/or a bill acceptor 26. The audit monitoring and product drop system 10 includes a control unit 12 including a microprocessor 14 for receiving and transmitting electrical signals to and from the bill validator 26 and coin mechanism 28 which are indicative of the funds received, the change to be dispensed, change available to be dispensed and for enabling and disenabling the bill acceptor 26 and coin mechanism 28. The microprocessor 14 further receives and transmits electrical signals to and from the main control board 20 which are indicative of funds received, the change to be dispensed and the status of the vending machine and receives signals from each of the product dispensing mechanisms 30 indicative of actuation thereof and of which particular product is to be vended. A product drop sensor 50 is operative to send a signal to the microprocessor 14 indicative of a product drop when a product drop to be dispensed drops through the product drop area 52. A memory 16 is provided for receiving and storing from the microprocessor 14 transaction information including products dispensed, total amount vended and funds in the means for receiving funds and dispensing change 29. The microprocessor 14 forwards to the memory 16 the transaction data only if a product drop is sensed by the product drop sensor 50 within a predetermined timing period initiated by energization of one of the product dispensing mechanisms 30. A method of operating vending machine is also disclosed.

We claim:

1. An audit monitoring and product drop system for retrofit into an existing vending machine having a product selector mechanism, a credit display, a main control board for controlling operation of the vending machine, a plurality of product dispensing mechanisms, each of which is operable to dispense a particular product through a product drop area, and means for receiving funds and dispensing change, said audit monitoring and product drop system comprising a control unit including a microprocessor for receiving and transmitting electrical signals to and from said means for receiving funds and dispensing change which signals are indicative of the funds received, the change to be dispensed, the change available to be dispensed, and for enabling and disenabling the means for receiving funds and dispensing change, said microprocessor further receiving and transmitting electrical signals to and from said main control board which are indicative of the funds received, the change to be dispensed, and the status of the vending machines, a plurality of first sensors one of which is associated with each of said plurality of product dispensing mechanisms for sensing actuation of its associated product dispensing mechanisms and for sending a signal to said microprocessor, from said first sensor indicative of actuation of said associated product dispensing mechanism and indicative of which particular product is to be dispensed, a product drop sensor operative to send a signal to said microprocessor indicative of a product drop when a product to be dispensed drops through said product drop area, a memory for receiving and storing from said microprocessor transaction information including products dispensed, total amount vended and funds in the means for receiving funds and dispensing change, and wherein the first sensor senses actuation of a product dispensing mechanism to dispense a particular product and the first sensor sends a signal to the microprocessor to initiate a predetermined timing period during which the microprocessor senses the output of said product drop sensor to determine if a product to be dispensed passes through the drop area and effects storage of the transaction information in the memory only if a product drop is sensed by the product drop sensor within said predetermined timing period.

2. An audit monitoring and product drop system for retrofit into an existing vending machine as defined in claim 1, wherein in the event said product drop sensor does not indicate that a product to be dispensed has passed through the product drop area within said predetermined timing period then said microprocessor sends a signal to the main control board to re-credit on the credit display the funds initially inputted into the means for receiving funds and dispensing change to enable a customer to reselect a product using the product selection mechanism or request a refund.

3. An audit monitoring and product drop system for retrofit into an existing vending machine as defined in claim 1, wherein said microprocessor instructs the main control board to refund any funds initially imputed into the means for receiving funds and dispensing change in the event a product drop is not sensed in the product drop area on two successive actuations of a product dispensing mechanism associated with a particular product.

4. An audit monitoring and product drop system for retrofit into an existing vending machine as defined in claim 1, wherein said means for receiving funds and dispensing change includes a coin mechanism for receiving, counting, storing and dispensing coins and for sending electrical signals to said microprocessor indicative thereof.

5. An audit monitoring and product drop system for retrofit into an existing vending machine as defined in claim 1, wherein said means for receiving funds and dispensing change include a bill acceptor for receiving, counting and validating currency received therein and providing electrical signals to the microprocessor indicative thereof.

6. An audit monitoring and product drop system for retrofit into an existing vending machine as defined in claim 4, wherein said means for receiving funds and dispensing change include a bill acceptor for receiving, counting and validating currency received therein and providing electrical signals to the microprocessor indicative thereof.

7. An audit monitoring and product drop system for retrofit into an existing vending machine as defined in claim 1, wherein said product drop sensor includes a plurality of electromagnetic radiation emitting elements which are adapted to be located on one side of said product drop area and each of which is operable to emit a beam of electromagnetic radiation across said product drop area, a reflector located on the opposite side of said product drop area as said electromagnetic radiation emitting elements are located for reflecting at least a portion of the beams of electromagnetic radiation from said electromagnetic radiation emitting elements back across said product drop area, a plurality of electromagnetic radiation detecting elements located on said one side of said product drop area for receiving the reflected electromagnetic radiation from said reflector which are operable to sense a change in the sensed electromagnetic radiation when a product to be dispensed drops through the electromagnetic radiation in the product drop area, said plurality of radiation detecting elements being operative to send a signal to said microprocessor indicative of a product drop when a product to be dispensed passes through said electromagnetic radiation in said product drop area.

8. An audit monitoring and product drop system for retrofit into an existing vending machine as defined in claim 2, wherein said microprocessor instructs the main control board to refund any funds initially imputed into the means for receiving funds and dispensing change in the event a product drop is not sensed in the product drop area on two successive actuations of a product dispensing mechanism associated with a particular product.

9. An audit monitoring and product drop system for retrofit into an existing vending machine as defined in claim 7, wherein said plurality of electromagnetic radiation emitting elements are located on a substantially unitary structure adapted to be easily mounted in the vending machine adjacent one side of the product drop area.

10. An audit monitoring and product drop system for retrofit into an existing vending machine as defined in claim 9, wherein said plurality of electromagnetic radiation detecting elements are located on said substantially unitary structure.

11. An audit monitoring and product drop system for retrofit into an existing vending machine as defined in claim 10, wherein said reflector comprises a self adhesive material having a retroreflective surface thereon.

12. An audit monitoring and product drop system for retrofit into an existing vending machine as defined in claim 10, wherein said unitary structure is mounted in a generally vertical orientation and includes a light shield for reducing the effect of ambient light on said electromagnetic radiation detecting elements.

13. An audit monitoring and product drop system for retrofit into an existing vending machine as defined in claim 1, wherein said first sensor for sensing actuation of each product dispensing mechanism is a voltage sensor.

14. An audit monitoring and product drop system for retrofitting into an existing vending machine having a product selector mechanism, a credit display, a main control board for controlling operation of the vending machine, a plurality of product dispensing mechanisms each of which is operable to dispense a particular product through a product drop area and means for receiving funds and dispensing change, said product drop system including a control unit having a microprocessor connected to said means for receiving funds and dispensing change and for receiving and transmitting electrical signals to and from said means for receiving funds and dispensing change which signals are indicative of the funds received, the change to be dispensed, the change available to be dispensed and for enabling and disenabling the means for receiving funds and dispensing change, said microprocessor further being connected to said main control board of said vending machine for receiving and transmitting electrical signals to and from said main control board of the vending machine which are indicative of the funds received, the change to be dispensed and the status of the vending machine, a first sensor for sensing actuation of said product dispensing mechanisms and for sending a signal to said microprocessor which is indicative of actuation of a particular product dispensing mechanism and indicative of which particular product is to be dispensed, a product drop sensor disposed adjacent to the product drop area of the vending machine and operably connected to said microprocessor to send a signal to the microprocessor indicative of a product drop when a product to be dispensed drops through said product drop area and wherein the actuation of a product dispensing mechanism to dispense a particular product is sensed by said first sensor which signals said microprocessor to initiate a predetermined timing period during which the microprocessor senses the output of said product drop sensor to determine if a product to be dispensed passes through the product drop area within said predetermined timing period.

15. An audit monitoring and product drop system for retrofit into an existing vending machine as defined in claim 14, wherein said first sensor is a voltage sensor connected to said product dispensing mechanism for sensing actuation thereof.

16. An audit monitoring and product drop system for retrofit into an existing vending machine as defined in claim 14, wherein said product drop sensor includes a plurality of electromagnetic radiation emitting elements which are adapted to be located on one side of said product drop area and each of which is operable to emit a beam of electromagnetic radiation across said product drop area, a reflector located on the opposite side of said product drop area as said electromagnetic radiation emitting elements are located for reflecting at least a portion of the beams of electromagnetic radiation from said electromagnetic radiation emitting elements back across said product drop area, a plurality of electromagnetic radiation detecting elements located on said one side of said product drop area for receiving the reflected electromagnetic radiation from said reflector which are operable to sense a change in the sensed electromagnetic radiation when a product to be dispensed drops through the electromagnetic radiation in the product drop area, said plurality of radiation detecting elements being operative to send a signal to said microprocessor indicative of a product drop when a product to be dispensed passes through said electromagnetic radiation in said product drop area.

17. An audit monitoring and product op system for retrofit into an existing vending machine as defined in claim 14, wherein said microprocessor instructs the means for receiving funds and dispensing change to refund any funds initially imputed in the event a product drop is not sensed in the product drop area on two successive actuations of a product dispensing mechanism associated with a particular product.

18. An audit monitoring and product drop system for retrofit into an existing vending machine as defined in claim 16, wherein said plurality of electromagnetic radiation emitting elements are located on a substantially unitary structure adapted to be easily mounted in the vending machine adjacent one side of the product drop area.

19. An audit monitoring and product drop system for retrofit into an existing vending machine as defined in claim 18, wherein said plurality of electromagnetic radiation detecting elements are located on said substantially unitary structure.

20. An audit monitoring and product drop system for retrofit into an existing vending machine as defined in claim 19, wherein said unitary structure is mounted in a generally vertical orientation and includes a light shield for reducing the effect of ambient light on said electromagnetic radiation detecting elements.

* * * * *